United States Patent [19]

Hirooka et al.

[11] Patent Number: 4,507,516

[45] Date of Patent: Mar. 26, 1985

[54] FUEL COMPOSITION

[75] Inventors: Seiji Hirooka; Michiaki Torii, both of Tokyo, Japan

[73] Assignee: Nippon Petrochemicals Co., Ltd., Japan

[21] Appl. No.: 589,644

[22] Filed: Mar. 14, 1984

[30] Foreign Application Priority Data

Mar. 18, 1983 [JP] Japan ..... 58-45704

[51] Int. Cl.[3] ..... C01J 1/04

[52] U.S. Cl. ..... 585/14; 149/109.4; 585/22; 585/253

[58] Field of Search ..... 60/208; 149/109.4, 109.6, 149/120; 585/14, 22, 253, 362, 360

[56] References Cited

U.S. PATENT DOCUMENTS 3,177,653 4/1965 Barnes et al. ..... 60/208
4,270,014 5/1981 Norton et al. ..... 60/208 X
4,277,636 7/1981 Norton et al. ..... 149/109.6 X
4,394,528 7/1983 Fisher ..... 60/208 X
4,427,467 1/1984 Burdette et al. ..... 149/109.4

FOREIGN PATENT DOCUMENTS 25669 7/1974 Japan ..... 585/22

*Primary Examiner*—Leland A. Sebastian
*Attorney, Agent, or Firm*—Ostrolenk, Faber, Gerb & Soffen

[57] ABSTRACT

A fuel composition comprising a hydrogenated material obtained by hydrogenating a reaction mixture ranging from $C_{11}$ to $C_{16}$ containing mainly compounds which comprise butadiene and cyclopentadiene as basic structural units, produced by reacting an acyclic conjugated diene with cyclopentadiene, dicyclopentadiene, an alkyl-substituted cyclopentadiene, or an alkyl-substituted dicyclopentadiene in accordance with Diels-Alder reaction an isomeric material prepared by isomerizing the hydrogenated material or the mixture of the hydrogenated material and the isomeric material.

4 Claims, No Drawings

FUEL COMPOSITION

BACKGROUND OF THE INVENTION

This invention relates to a liquid hydrocarbon fuel composition having high density and high heat of combustion.

High energy liquid fuel has been utilized for rockets as well as jet engines such as turbo-jet, ram-jet, pulse jet and the like. In order to increase thrust force of rockets and jet engines, fuel having high combustion energy as much as possible per unit volume, i.e., liquid fuel having high density and high heat of combustion is required. Furthermore, since liquid fuel is supplied to combustion chambers through pipes, or used in combination with liquid oxygen, or employed for flying objects in ultra-high altitude region at low temperature, suitable viscosity, freezing point, and pour point are required for such liquid fuel. In addition, it is also necessary that liquid fuel is non-corrosive to engines and the like properties.

Heretofore, there have been exo-isomer of hydrogenated dicyclopentadiene known as JP-10 (British Patent Publication No. 1182610), perhydroinorbornadiene known as RJ-5, and the like as the liquid fuel which can satisfy the requirements as mentioned above. However, the former fuel has disadvantages such as insufficient net heat of combustion, insufficient density and the like, whilst the latter liquid fuel has such a disadvantage in that the cost therefore is extremely high, because synthesis of the fuel is difficult, besides a raw material of norbornadiene is insufficiently supplied.

OBJECTS OF THE INVENTION

It is an object of the present invention to provide a liquid hydrocarbon fuel composition of high density and high heat of combustion which has low pour point and which is suitable for rocket or jet engine fuel composition.

It is another object of the present invention to provide a fuel composition which is easy to synthesize and inexpensive.

SUMMARY OF THE INVENTION

The present invention relates to a fuel composition comprising a hydrogenated material obtained by hydrogenating a reaction mixture ranging from $C_{11}$ to $C_{16}$ containing mainly compounds which comprise butadiene and cyclopentadiene as basic structural units, and produced by reacting an acyclic conjugated diene with cyclopentadiene, dicyclopentadiene, an alkyl-substituted cyclopentadiene, or an alkyl-substituted dicyclopentadiene in accordance with Diels-Alder reaction, an isomeric material prepared by isomerizing the aforesaid hydrogenated material, or the mixture of the hydrogenated material and the aforesaid isomeric material.

DETAILED DESCRIPTION OF THE INVENTION

Acyclic conjugated diene being a raw material of the liquid fuel composition according to the present invention is preferably $C_4$–$C_6$ conjugated diene such as 1, 3-butadiene, isoprene, 1, 3-pentadiene,2, 3-dimethylbutadiene or the like, and particularly preferable is 1, 3-butadiene.

Another raw material is cyclopentadiene (CPD), dicyclopentadiene (DCPD), or the respective alkyl-substituted compounds thereof (hereinafter referred generically to as "CP"). Methyl-cyclopentadiene (MCPD) and dimethyldicyclopentadiene (DMCPD) are preferably used as the alkyl-substituted compounds, and they may be employed in the form of mixture. In this case, pure CP is not necessarily required.

Diels-Alder reaction may be conducted in accordance with well-known thermal Diels-Alder reaction, and such reaction may be effected in either batchwise or continuous operation. Preferable is a process wherein DCPD or DMCPD is subjected to thermal decomposition to produce CPD or MCPD, and either product is reacted with an acyclic conjugated diene. A molar ratio of the acyclic conjugated diene/CP is within a range of 0.05–10, and preferably a range of 0.25–2. A reaction temperature ranges from 50° to 250° C. and preferably from 100° to 200° C. in the case where CPD or MCPD is used as CP, whilst a reaction temperature ranges from 100° to 250° C. and preferably from 120° to 200° C. in the case where DCPD or DMCPD is utilized as CP. A reaction time is within a range of 30 minutes–10 hours, and preferably a range of 1–5 hours. When the reaction is conducted, either a polymerization inhibitor such as p-phenylenediamine, hydroquinone, hydroquinonemonomethylether, tert-butylcatechol or the like may be added to the reaction system, or such reaction may be conducted in a solvent such as lower alcohol, e.g., methanol or ethanol, hydrocarbon such as toluene, cyclohexane and the like, or monocarboxylic ester having 2–7 carbon atoms and the like to inhibit production of polymers.

Furthermore a catalyst, for example, copper salt, chromium salt, or phosphine or phosphite complex of nickel, palladium, platinum and the like may also be added at need to the reaction system.

In Diels-Alder reaction of acyclic conjugated diene with CP, various adducts are produced. More specifically, since both of acyclic conjugated diene and CP are not only dienes, but also function as dienophile reagents, various adducts are obtained. In this case, since the resulting adducts are also dienophile reagents, such adducts react further with conjugated diene to produce higher adducts. For instance, taking the case of Diels-Alder product of butadiene with CPD, we can obtain such primary adducts respectively as 5-vinylnorbornene (VNB) and tetrahydrofuran (THI) being an adduct of butadiene and CPD, vinylcyclohexene (VCH) obtained in the reaction of butadiene itself, DCPD obtained in the reaction of CPD itself, and so forth. In addition, according to Diels-Alder reaction of such primary adducts with butadiene or CPD, various higher adducts are produced.

When DCPD is utilized in place of CPD as a starting material, a part of which is thermally decomposed to produce CPD so that the same primary and higher adducts with those where CPD is employed as the raw material are obtained. However, the unreacted DCPD in the production of such primary adduct becomes a raw material of higher adducts.

In the present invention, the reaction mixture within a range of $C_{11}$–$C_{16}$ among reaction mixtures containing the aforesaid various adducts of which major components are compounds comprising butadiene and cyclopentadiene as basic structural units, is utilized as a raw material of the fuel composition. The reaction product of below $C_{11}$ is hydrocarbon containing the above described primary adduct and the like as the major components, but such reaction product is not preferable because of its low density. On the other hand, the reaction product exceeding $C_{16}$ is also not preferable, because the freezing point and pour point are high, and its viscosity is also high.

Density of the above-mentioned reaction mixture is extremely high, and this is because products having a density of 0.97–1.09 are contained in the mixture as the major components.

Since the aforesaid respective adducts are obtained from Diels-Alder reaction products of acyclic conjugated diene and CP as the mixture in the form of fraction, when such mixture is adjusted to have a prescribed range of carbon atom by means of distillation, the mixture thus adjusted can be utilized as a raw material of the present invention. Especially, a by-product heavy fraction when producing VNB in accordance with Diels-Alder reaction of butadiene with CP is inexpensive so that said heavy fraction is the most preferable raw material in the present invention. It is to be noted that the operation for adjusting a range of carbon atom to a prescribed range may be effected at any step before and after the operation for the undermentioned hydrogenation or isomerization.

The above described reaction mixture, however, comprises unsaturated compounds involving diene as the major components so that such reaction mixture is defficient in calorific value and long-term storage stability. Thus, the reaction mixture is unsuitable for fuel composition without any modification. In this respect, such reaction mixture is subjected to hydrogenation to preferably make diene to be a perhydro-compound, whereby the reaction mixture is hydrogenated and comprises saturated hydrocarbons.

Hydrogenation of the above described reaction mixture can be carried out by utilizing such known method as hydrogenating unsaturated hydrocarbons. More specifically, the hydrogenation can easily be effected by the use of a noble metal catalyst such as platinum, palladium or rhodium, or the other various catalysts such as Raney nickel and nickel in the presence or absence of a solvent such as alcohols, esters or ethers as tetrahydrofuran at a temperature of 25°–225° C. under a pressure of 1–140 kg/cm$^2$. Such hydrogenation may also be carried out in two-stage process. After the hydrogenation, decomposition products and unreacted materials are separated, and if required, a slight amount of impurities is removed by absorption thereby obtaining purified fuel.

The aforesaid hydrogenation may be also conducted by such two-stage process that dihydrogenation is carried out in the first stage and then, hydrogenation is continued up to the production of perhydro-compound in the second stage.

The hydrogenated products prepared by the above hydrogenation have high density and high heat of combustion, and sufficiently low pour point and freezing point so that such hydrogenated products are suitably utilized as fuel composition without any modification.

However, the hydrogenation of the above hydrogenated products may be followed by isomerization treatment in order to further improve low-temperature properties such as pour point, freezing point and the like. The principal object of such isomerization resides in that the whole or a part of endo-compounds in the hydrogenated products are isomerized to exo-compounds. The isomerization treatment is easily attained by contacting the endo-compounds with Bronsted acid such as sulfuric acid at a temperature ranging from 15° to 100° C. for 1 minute to 30 hours. Care must be taken in case of using strong Lewis acid such as aluminum chloride or aluminum bromide, because of a possibility of producing isomers other than the exo-compounds. In this respect, it is recommended that the above described treatment is carried out by utilizing a solvent such as methylene chloride at a comparatively low temperature within a range of 0°–50° C. in case of employing aluminum chloride or the like.

The isomerization may also be effected in accordance with either process disclosed in British Patent Publication No. 1182610 and U.S. Pat. No. 4,286,109.

The fuel composition according to the present invention is characterized by a mixture consisting of plural components so that the present fuel composition has an advantage in that the pour point and freezing point reduce remarkably as compared with the case wherein each fuel composition consists of a single component instead of the aforesaid plural components.

In addition, the fuel composition of the present invention has such advantages that the density of which is extremely high, i.e., 0.94 or more and the net heat of combustion is also extremely high, i.e., 18100 BTU/lb or more.

Even the fuel composition of the invention prior to isomerization, in other words, the fuel composition which has merely been subjected to hydrogenation has sufficiently low pour point and freezing point. For this reason, such isomerization treatment by which low-temperature properties are improved, but which has a tendency that density of fuel composition lowers in general may suitably be omitted dependent on the physical properties required in the fuel, or may be effected by changing proportion of the isomerization.

Furthermore, for the fuel composition of the present invention products obtained in accordance with Diels-Alder reaction of acyclic conjugated diene with CP can be utilized as the raw material therefor in the form of mixture without accompanying any separation, purification and the like so that the products of mixture are more advantageous than a product of single compound from economical point of view. Particularly, when by-products obtained where VNB is produced from butadiene and CPD are utilized, the economical advantage thereof is remarkable.

The fuel composition according to the present invention has advantages in that it is non-corrosive to metal and that it has long-term storage stability, because the fuel composition contains no unsaturated component. However, an appropriate stabilizer may arbitrarily be added to such fuel composition.

The fuel composition according to the present invention may be used along or in a suitable admixture with one or more of well-known fuel. Examples of the well-known fuel include synthetic fuel such as a material prepared by isomerizing hydrogenated dimer of CPD or MCPD disclosed in British Patent Publication No. 1182610; exo-tetrahydrodicyclo-pentadiene, hydrogenated trimer of CPD or MCPD, and a mixture of $C_5$–$C_7$ alkane or cycloalkane disclosed in U.S. Pat. No. 4,286,109; dihydronorbornadiene well known as RJ-5; hydrogenated trimer of CPD or MCPD disclosed in U.S. Pat. No. 4,277,636; di- or tricyclohexylalkane type compounds disclosed in British Pat. No. 977322; and mono- or dicyclohexyldicyclic alkane type compounds disclosed in British Pat. No. 977323; or mineral oil fuel such as mixtures of naphthenic hydrocarbon and isoparaffinic hydrocarbon disclosed in Japanese patent laidopen No. 139186/1982; and materials disclosed in Canadian Pat. Nos. 995845 and 907852, U.S. Pat. Nos. 3,308,052, 3,384,574 and 3,567,602, and Japanese patent publication Nos. 16121/1963, 30462/1970, 40545/1971, 17523/1973 and 45684/1974 respectively.

EXAMPLE 1

1000 g of an admixture of butadiene and cyclopentadiene in molar ratio 1:1 were placed in a stainless steel autoclave having 3l internal volume, and the admixture was reacted at 160° C. for 3 hours. After completing the reaction, the resulting products were distilled to obtain 161 g of fraction having boiling range of 75°-92° C. at 1.5 mmHg. Composition of the fraction was as indicated in the following Table 1 and it was $C_{13}$-$C_{15}$ mixture.

TABLE 1

| Composition of Fraction | Example 1 (%) | Example 2 (%) |
|---|---|---|
| Reaction Product of Butadiene and VNB | 14.6 | 16.8 |
| Reaction Product of CPD and VNB | 18.1 | 6.3 |
| Reaction Product of Butadiene and DCPD | 38.4 | 55.5 |
| Tricyclopentadiene | 17.3 | 17.6 |
| The Others | 11.6 | 3.8 |

Then, the fraction was completely hydrogenated until perhydro-compound is obtained by the use of a hydrogenation catalyst (nickel-diatomaceous earth) at first at 110° C. under 15 kg/cm$^2$ hydrogen pressure, and later at 220° C., 30 Kg/Cm$^2$ hydrogen pressure. It was confirmed by NMR spectrum or IR spectrum that the compounds in the hydrogenated fraction did not involve unsaturated bonds. The hydrogenated products were distilled to remove more volatile components thereby obtaining a fuel composition.

Various physical properties of the composition will be indicated hereinbelow wherein both the density and calorific value are high, whilst both the freezing point and pour point are sufficiently low without applying particularly any isomerization treatment, and the composition has low viscosity. Hence, such composition can favorably be utilized as the fuel for rockets or the like with no modification.

(Physical Properties)
Density: 0.99
Freezing Point: below −60° C.
Pour Point: below −60° C.
Viscosity (@−20° C.): 91.8 cSt
Net Heat of Combustion: 18220 BTU/lb
Distillation Property: (IBP) 245° C., (50%) 267° C. (90%) 278° C., (EP) 287° C.

EXAMPLE 2

1000 g of a mixture of butadiene and dicyclopentadiene in molar ratio 2:1 were placed in a stainless steel autoclave having 3l internal volume, and the mixture was reacted at 165° C. for 2 hours. After completing the reaction, the resulting products were distilled to obtain 240 g of fraction having boiling range of 90°-125° C. at 10 mmHg. Composition of the fraction was as indicated in Table 1 and it was $C_{13}$-$C_{15}$ mixture. Density of the fraction was 1.03.

Then, the fraction was completely hydrogenated at 100° C. under 20 kg/cm$^2$ hydrogen pressure in the presence of a hydrogenation catalyst (Raney nickel). The hydrogenated products were distilled to remove volatile components thereby obtaining a fuel composition.

The resulting fuel composition had freezing point of below −60° C., pour point of below −60° C., density of 0.99, and net heat of combustion of 18200 BTU/lb.

EXAMPLE 3

100 g of the fuel composition of Example 2 was subjected to mixing and agitation together with 100 g of 99.5±0.5 % sulfuric acid at a temperature of 90°±5° C. for 6 hours. After completing the reaction, sulfuric acid was separated, and the hydrocarbon layer was purified by means of neutralization and dehydration thereby to obtain an isomerized fuel composition. The resulting fuel composition exhibited the same values with those of the composition of Example 2 except that the freezing point and pour point lowered to below −80° C. and the density lowered slightly as compared with the values of Example 2.

EXAMPLE 4

1000 g of a mixture of isoprene and cyclopentadiene in molar ratio 1:1 were placed in an autoclave of 3l internal volume, and the mixture was reacted at 200° C. for 2 hours. After completing the reaction, the resulting products were distilled to obtain 112 g of fraction having boiling range of 83°-110° C. (5 mmHg).

The fuel composition obtained by hydrogenating the resulting fraction in accordance with the same manner as that of Example 1 had freezing point of below −40° C. density of 0.97, and net heat of combustion of 18400 BTU/lb. The fuel composition which had been subjected further to isomerization treatment in accordance with the same manner as that of Example 3 had the same net heat of combustion except that the freezing point lowered to below −60° C.

What is claimed is:

1. A fuel composition comprising a hydrogenated material obtained by hydrogenating a reaction mixture ranging from $C_{11}$ to $C_{16}$ containing mainly compounds which comprise butadiene and cyclopentadiene as basic structural units produced by reacting an acyclic conjugated diene with cyclopentadiene, dicyclopentadiene, an alkyl-substituted cyclopentadiene, or an alkyl-substituted dicyclopentadiene in accordance with Diels-Alder reaction, an isomeric material prepared by isomerizing the hydrogenated material or the mixture of the hydrogenated material and the isomeric material.

2. A fuel composition as claimed in claim 1 wherein said acyclic conjugated diene is selected from butadiene, isoprene, 1,3-pentadiene and 2,3-dimethylbutadiene.

3. A fuel composition as claimed in claim 1 wherein said alkyl-substituted compound is methylcyclopentadiene or dimethyldicyclopentadiene.

4. A fuel composition as claimed in claim 1 wherein said hydrogenated material is perhydro-compound.

* * * * *